US006722301B2

(12) United States Patent
Nagata et al.

(10) Patent No.: US 6,722,301 B2
(45) Date of Patent: Apr. 20, 2004

(54) ARTICLE STORAGE STRUCTURE FOR A SMALL BOAT

(75) Inventors: Tadaaki Nagata, Saitama (JP); Jun Nakajima, Saitama (JP); Koji Mizuta, Saitama (JP); Hirotsugu Ueno, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,057

(22) Filed: Aug. 30, 2002

(65) Prior Publication Data

US 2003/0066473 A1 Apr. 10, 2003

(30) Foreign Application Priority Data

Sep. 6, 2001 (JP) ..... 2001-269899

(51) Int. Cl.[7] ..... B63C 7/00
(52) U.S. Cl. ..... 114/55.53
(58) Field of Search ..... 114/343, 361, 114/363, 364, 55.5, 55.53, 55.57, 55.51

(56) References Cited

U.S. PATENT DOCUMENTS 5,076,190 A * 12/1991 Iikawa ..... 114/55.53
5,619,950 A * 4/1997 Ikeda ..... 114/363
5,894,810 A * 4/1999 Orr ..... 114/343
6,062,154 A * 5/2000 Ito ..... 114/55.57
6,112,686 A * 9/2000 Tsumiyama et al. ..... 114/55.53
6,234,546 B1 * 5/2001 Asakura et al. ..... 292/165
6,276,290 B1 * 8/2001 Yamada et al. ..... 114/55.51
6,578,508 B2 * 6/2003 Hattori et al. ..... 114/55.57

FOREIGN PATENT DOCUMENTS

JP 2000-238693 A 9/2000

* cited by examiner

*Primary Examiner*—S. Joseph Morano
*Assistant Examiner*—Lars A. Olson
(74) *Attorney, Agent, or Firm*—Birch, Stewart, Kolasch & Birch, LLP

(57) ABSTRACT

To provide an article storage structure for a small boat in which the forward visibility of the small boat can be increased substantially and the center of gravity of the small boat can be lowered. The article storage structure for a small boat includes a steering handle for a hull disposed thereon. A display panel is disposed forwardly of the steering handle. An article storage box is provided forwardly of the display panel. A lid is provided for covering the upper surface opening of the article storage box. A hinge is provided at the front end of the lid. A latch is provided at the rear end for locking the lid. The article storage structure for a small boat includes a downwardly recessed mounting bracket provided forwardly of the display panel and rearwardly of the article storage box. An engaging member is provided on the mounting bracket.

22 Claims, 7 Drawing Sheets

BACKGROUND ART

ARTICLE STORAGE STRUCTURE FOR A SMALL BOAT

CROSS-REFERENCE TO RELATED APPLICATIONS

This application claims priority under 35 U.S.C. §119 on Application No. 2001-269899, filed in Japan on Sep. 6, 2001, the entirety of which is hereby incorporated by reference.

BACKGROUND OF THE INVENTION

1. Field of the Invention

The present invention relates to an article storage structure for a small boat including a handle at a front portion of the hull, a display panel mounted forwardly of the handle, and an article storage box provided forwardly of the display panel.

2. Description of Background Art

A jet propulsion boat is a vessel provided with a jet pump mounted at a rear portion of the hull. The jet propulsion boat is propelled by sucking water from the vessel bottom by driving the jet pump with an engine, and splashing the sucked water rearward.

A jet propulsion boat is disclosed, for example, in Japanese Patent Laid-Open No.238693/2000 entitled "PERSONAL WATERCRAFT." The jet propulsion boat of the above document will be described in detail referring to FIG. 7 of the present invention, which is a principal portion of FIG. 2 of the above document. It should be noted that reference numerals have been re-designated in FIG. 7.

FIG. 7 is a cross sectional view showing a small boat provided with an article storage structure of the background art, in which a jet propulsion boat 100 includes a handle 102 disposed at a front portion 101*a* of the hull 101. A speedometer 103 is disposed forwardly of the handle 102. A dough box (article storage box) is 105 disposed forwardly of the speedometer 103. A cover (lid) 106 covers the upper end opening 105*a* of the article storage box 105. A hinge is provided at the front end 106*a* of the lid 106 for enabling the lid to be swung in the vertical direction. Furthermore, a locking member such as a latch is provided at the rear end 106*b* of the lid 106 for locking the lid 106 in the closed position.

According to the article storage box 105, the upper end opening 105*a* of the article storage box 105 can be opened by releasing the locked state of the locking member, swinging the lid 106 about the hinge and lifting the lid 106 to the opened position. The upper opening 105*a* of the article storage box 105 can be closed by swinging the lid 106 about the hinge and moving the lid 106 downward to the closed position.

However, the upper end opening 105*a* of the article storage box 105 is substantially flush with the surface of the hull 101. Accordingly, the lid for covering the upper opening 105*a* is elevated upward from the surface of the hull 101. Therefore, in order for the operator to see adjacent the distal end 101*b* of the hull 101, the operator must raise his/her body to elevate his/her eye line.

In addition, the lid 106 of the jet propulsion boat 100 must have an increased sealing property to prevent seawater from entering from the upper end opening 105*a* into the article storage box 105. Therefore, the lid 106 must be a rigid, uncrushable structure. Accordingly, the lid 106 provides a relatively heavy load.

The disposition of such a heavy lid 106 elevated from the surface of the hull 101 has been providing an impedance to the lowering of the center of gravity of the jet propulsion boat 100.

SUMMARY OF THE INVENTION

Accordingly, it is an object of the present invention to provide an article storage structure for a small boat in which the forward visibility of the small boat is more preferably secured and the center of gravity of the small boat can be lowered.

In order to solve the above problems of the background art, the present invention is directed to a small boat comprising a bar-type handle disposed on the centerline along the width of the hull, a display panel for displaying the gauges disposed forwardly of the handle, an article storage box disposed forwardly of the display panel, a lid covering the upper surface of the article storage box, a hinge provided at the front end of the lid, and a locking member provided at the rear end for locking the lid, wherein a downwardly recessed portion is provided forwardly of the display panel and rearwardly of the article storage box, and an engaging member to be engaged with the locking member is provided in the recessed portion.

The downwardly recessed portion is provided forwardly of the display panel and rearwardly of the article storage box, and the engaging member is provided in the recessed portion. Therefore, the lid of the article storage box can be moved downward in coordination with the engaging member, and thus the front visibility of the operator can be increased when compared with the background art.

In addition, the lid of the article storage box can be moved downward in coordination with the engaging member. Accordingly, the center of gravity of the small boat can be further lowered.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
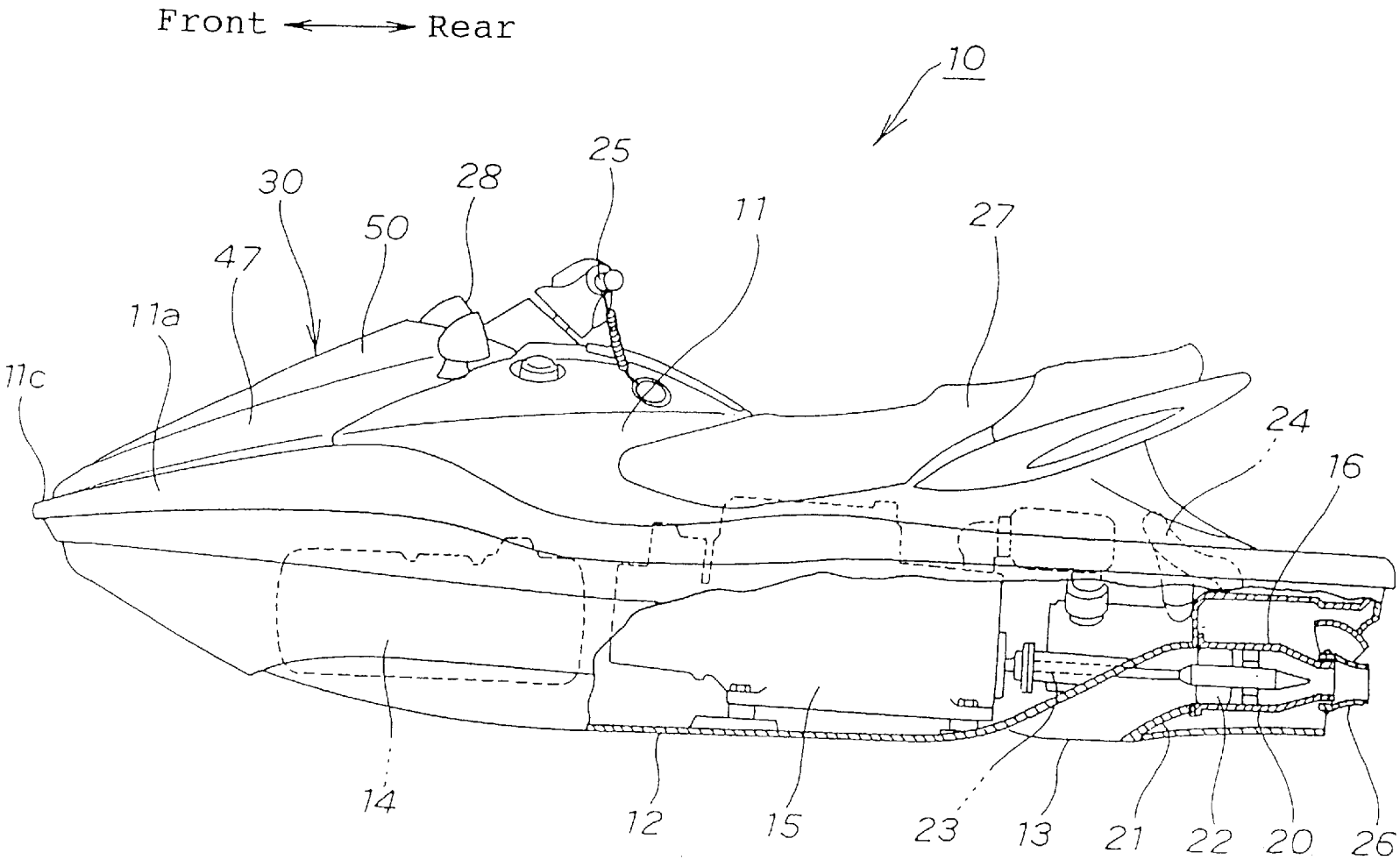
FIG. 1 is a side view of a small boat provided with an article storage structure according to the present invention.

Referring to the accompanying drawings, an embodiment of the present invention will now be described below. The drawings should be viewed in the direction of the orientation of the reference numerals. Although the present invention can be applied to any type of small boat, a jet propulsion boat in the form of a personal watercraft will be described below as an example.

FIG. 1 is a side view of a small boat comprising an article storage structure according to the present invention. The jet propulsion boat 10 includes a fuel tank 14 mounted at a front portion 11*a* of the hull 11. An engine 15 is provided rearwardly of the fuel tank 14. A pump chamber 16 is provided rearwardly of the engine 15. A jet pump 20 is provided in the pump chamber 16. An exhaust pipe 24 is attached to the engine 15 on the air intake side and to the pump chamber 16 on the exhaust side. A bar-type steering handle of handlebar 25 (handle hereinafter) is disposed on the center line along the width of the hull 11. A seat 27 is mounted rearwardly of the steering handle 25. A display panel 28 for displaying a speedometer or other gauges is provided forwardly of the steering handle 25. Furthermore, an article storage structure 30 is provided forwardly of the display panel 28.

The jet pump 20 includes a housing 21 extending rearward from an opening 13 of the vessel bottom 12. An impeller 22 is rotatably mounted in the housing 21 and is connected to a drive shaft 23 of the engine 15.

The jet pump 20 is used to suck water from the opening 13 of the vessel bottom 12. The water can be splashed or sprayed through the rear end opening of the housing 21 from the steering nozzle 26 rearwardly of the hull 11. Driving the engine 15 and rotating the impeller 22 operates the jet pump 20.

The vessel 10 can be propelled by supplying fuel from the fuel tank 14 to the engine 15 to drive the engine 15. A driving force of the engine 15 is transmitted to the impeller 22 via the drive shaft 23. Rotating the impeller 22 sucks water from the opening 13 of the vessel bottom 12 and splashing or spraying the sucked water through the rear end of the housing 21 from the steering nozzle 26 propels the vessel 10.

Figure 2:
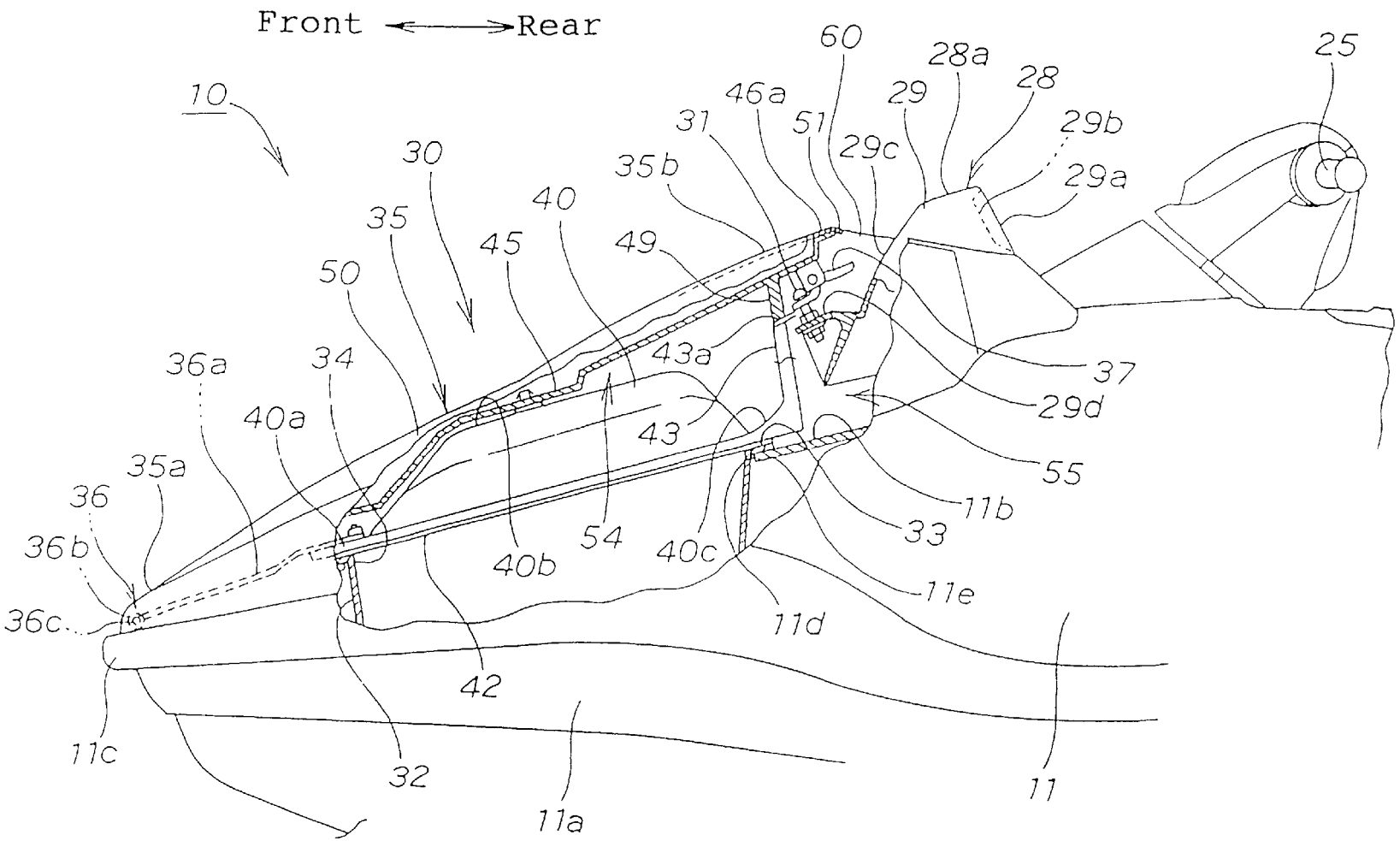
FIG. 2 is a side view of the article storage structure for a small boat according to the present invention.

FIG. 2 is a side view of the article storage structure for a small boat according to the present invention showing a state in which the display panel 28 is provided forwardly of the steering handle 25. The article storage structure 30 is provided forwardly of the display panel 28.

The display panel 28 is constructed in such a manner that an opening 29*a* is formed at a rear end of the casing 29. A display portion 29*b* is mounted in the opening 29*a*. The front end of the casing 29 has an anteverted surface 29*c*. The anteverted surface 29*c* is inclined downwardly toward the front. A mounting bracket 29*d* is formed at a substantial center of the anteverted surface 29*c*.

By forming the mounting bracket 29*d* at the substantial center of the anteverted surface 29*c*, the mounting bracket 29*d* may be formed into a recessed portion located downwardly from the top 28*a* of the display panel 28. The mounting bracket 29*d* is a recessed portion, which is provided with an engaging member 31.

The hull 11 is constructed in such a manner that the upper wall 11*b* of the front portion 11*a* is disposed below the display panel 28. The upper wall 11*b* is inclined downwardly toward the distal end 11*c* of the hull 11. An opening (upper wall opening) 11*d* is formed at a substantial center of the upper wall 11*b*. The article storage box 32 of the article storage structure 30 is fitted into the upper wall opening 11*d*.

The downwardly recessed portion (that is, the mounting bracket) 29*d* is provided forwardly of the display panel 28 and rearwardly of the article storage box 32. The engaging member 31 is provided on the mounting bracket 29*d*. Therefore, the lid 35 of the article storage box 32 can be moved downward into cooperation with the engaging member 31. Since the lid 35 of the article storage box 32 can be moved downward to cooperate with the engaging member 31, the center of gravity of the jet propulsion boat 10 can be further lowered.

The article storage structure 30 for a small boat is constructed in such a manner that the article storage box 32 is embedded in the hull 11 so that the upper end opening (upper surface) 34 of the article storage box 32 is substantially flush with the upper wall 11*b*. This is accomplished by fitting the article storage box 32 in the upper wall opening 11*d* of the hull 11 and placing a flange 33 of the article storage box 32 on a peripheral edge 11*e* of the upper wall opening lid. The upper end opening 34 is covered by the lid 35. Furthermore, the lid 35 is provided with a hinge 36 at a front end 35*a* of the lid 35. A latch (locking member) 37 is provided on the lid 35 for locking the lid 35 at the rear end 35*b*.

The hinge 36 is mounted on the lid 35 by the steps of mounting a hinge plate 36*a* on the front end 40*a* of the lid body 40, and inserting a rod 36*c* into a fitting portion 36*b* at the distal end of the hinge plate 36*a*. Accordingly, the hinge plate 36*a* is rotatably mounted on the distal end 11*c* of the hull 11 via a rod 36*c*.

The lid 35 includes the lid body 40 for closing the upper end opening 34 of the article storage box 32. A protective cover 45 is provided for protecting the hinge plate 36*a*, the upper end portion 40*a* of the lid body 40 and the lid body 40. A decorative cover 50 is provided for covering the protective cover 45. A fitting portion 36*b* is provided at the distal end of the hinge plate 36*a* and is rotatably attached at the distal end 11*c* of the hull 11 via a rod 36*c*. The locking member (latch) 37 is mounted at the back surface of the rear end of the protective cover 45.

The lid 35 can be locked in the closed position by closing the lid 35 and engaging the latch 37 with the engaging member 31. The upper end opening 34 of the article storage box 32 can be sealed by the lid body 40.

Furthermore, the space 54 between the lid body 40 and the protective cover 45 can be closed off from the storing space 55 at the rear by providing a partition wall 43 at the rear end 40*c* of the lid body 40 and bringing the upper end 43*a* of the partition wall 43 into contact with the projection 49 of the protective cover 45. Therefore, seawater can be prevented from entering the storing space 55 from the space 54 between the lid body 40 and the protective cover 45.

The storing space 55 provides sufficient space for accommodating the mounting bracket 29*d* as a recessed portion. The storing space 55 further provides sufficient space for accommodating the engaging member 31 mounted on the mounting bracket 29*d* and the latch 37 for engaging the engaging member 31.

Figure 3:
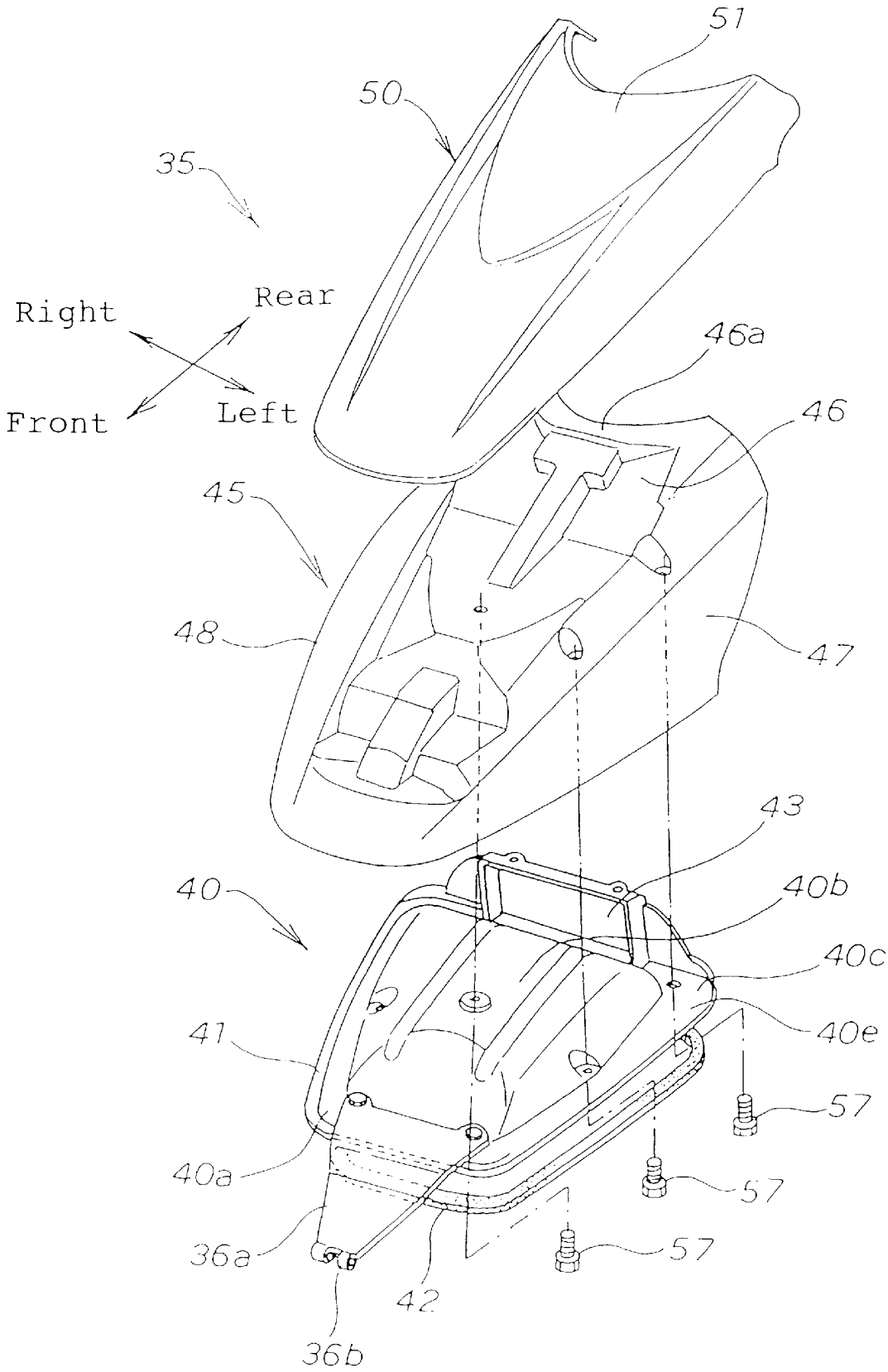
FIG. 3 is an exploded perspective view of the lid that constitutes the article storage structure for a small boat according to the present invention.

FIG. 3 is an exploded perspective view of the lid constituting the article storage structure for a small boat according to the present invention. The lid 35 includes, as shown in FIG. 2, the lid body 40, the protective cover 45, and the decorative cover 50 overlapping in order from the bottom.

The three members of the lid, i.e. the lid body 40, the protective cover 45, and the decorative cover 50, are integrally assembled by assembling the lid body 40 and the protective cover 45 integrally by means of screws 57. The protective cover 45 and the decorative cover 50 are then integrally assembled with an engaging member (not shown).

The lid body 40 is a member, which includes an outer frame 41 formed into a substantially trapezoidal shape. A seal member 42 is provided along the outer frame 41. A hinge plate 36*a* is secured at the front end 40*a* by means of a screw. A central portion 40*b* is elevated upward, and a partition wall 43 is provided at the rear end 40*c* of the lid body 40.

The lid body 40 can be mounted to the distal end 11*c* (shown in FIG. 2) of the hull 11 via a hinge plate 36*a* so as to enable a swinging motion by inserting the rod 36*c* (shown in FIG. 2) into the fitting portion 36*b* at the distal end of the hinge plate 36*a*.

The upper end opening 34 can be reliably sealed by attaching the seal member 42 on the peripheral edge 11*e* of the lid body 40, and bringing the seal member 42 into contact with the flange 33 (shown in FIG. 2) of the upper end opening 34 of the article storage box 32.

The protective cover 45 is a member, which includes the upper wall 46 and the left and the right side walls 47, 48. The protective cover 45 is constructed in such a manner that the left and the right side walls 47, 48 are exposed upwardly of the hull 11 (shown in FIG. 1) as the outer frame. The rear end 46*a* of the upper wall 46 is formed into a recessed curve. The latch 37 (shown in FIG. 2) is mounted on the back surface of the rear end 46*a*. The decorative cover 50 is a member for covering the upper wall 46 of the protective cover 45. The rear end 51 is formed into a recessed curve.

Referring back to FIG. 2, an opening 60 is formed between the protective cover 45 and the decorative cover 50 and the anteverted surface 29*c* of the display panel 28 by forming the rear end 46*a* of the protective cover 45 with a recessed curve and forming the rear end 51 of the decorative cover 50 with a recessed curve. The latch 37 can be operated by inserting a hand through the opening 60 by facing the opening 60 toward the storing space 55.

Figure 4:
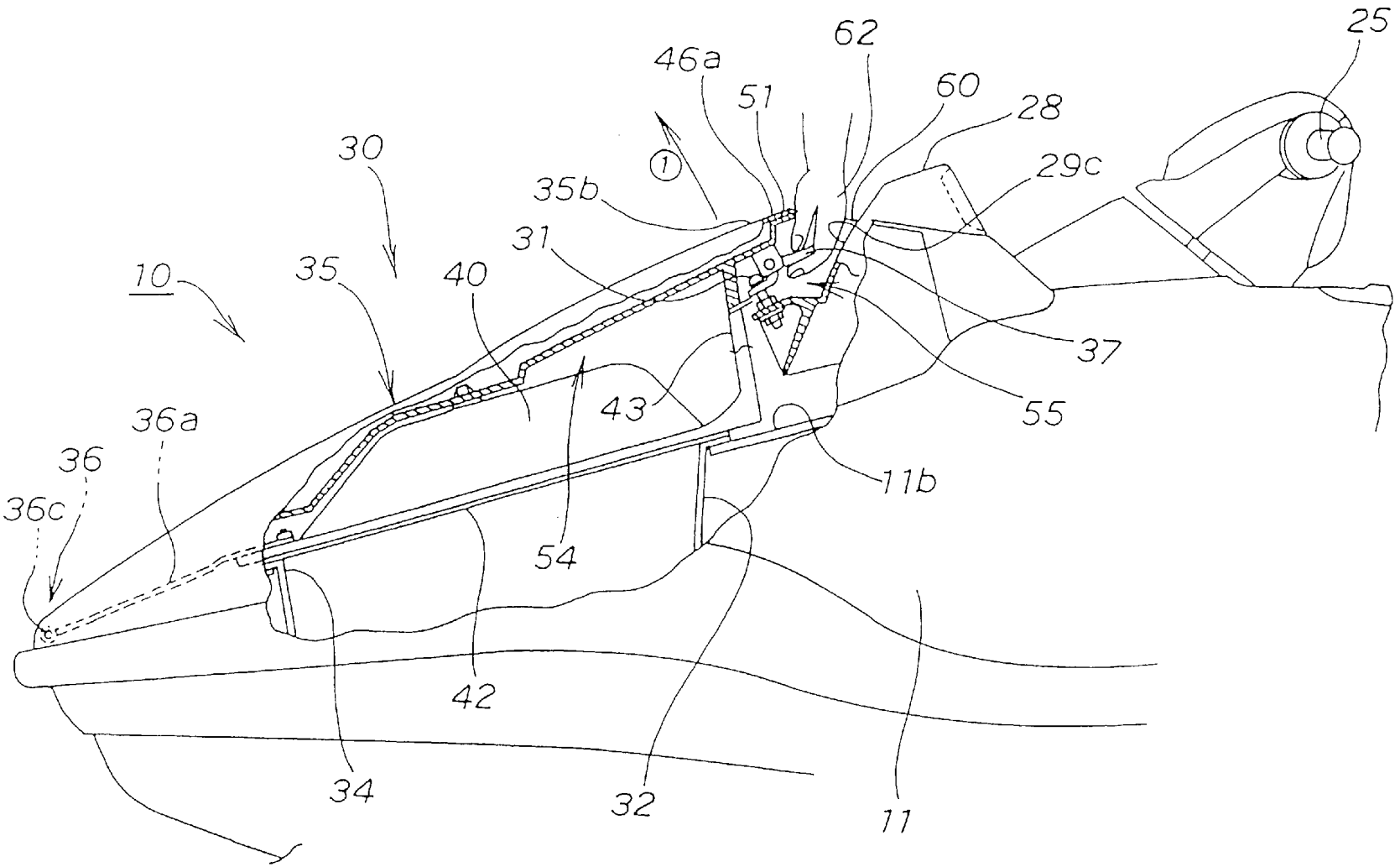
FIG. 4 is a first explanatory drawing illustrating the operation of the article storage structure for a small boat according to the present invention.
Figure 5:
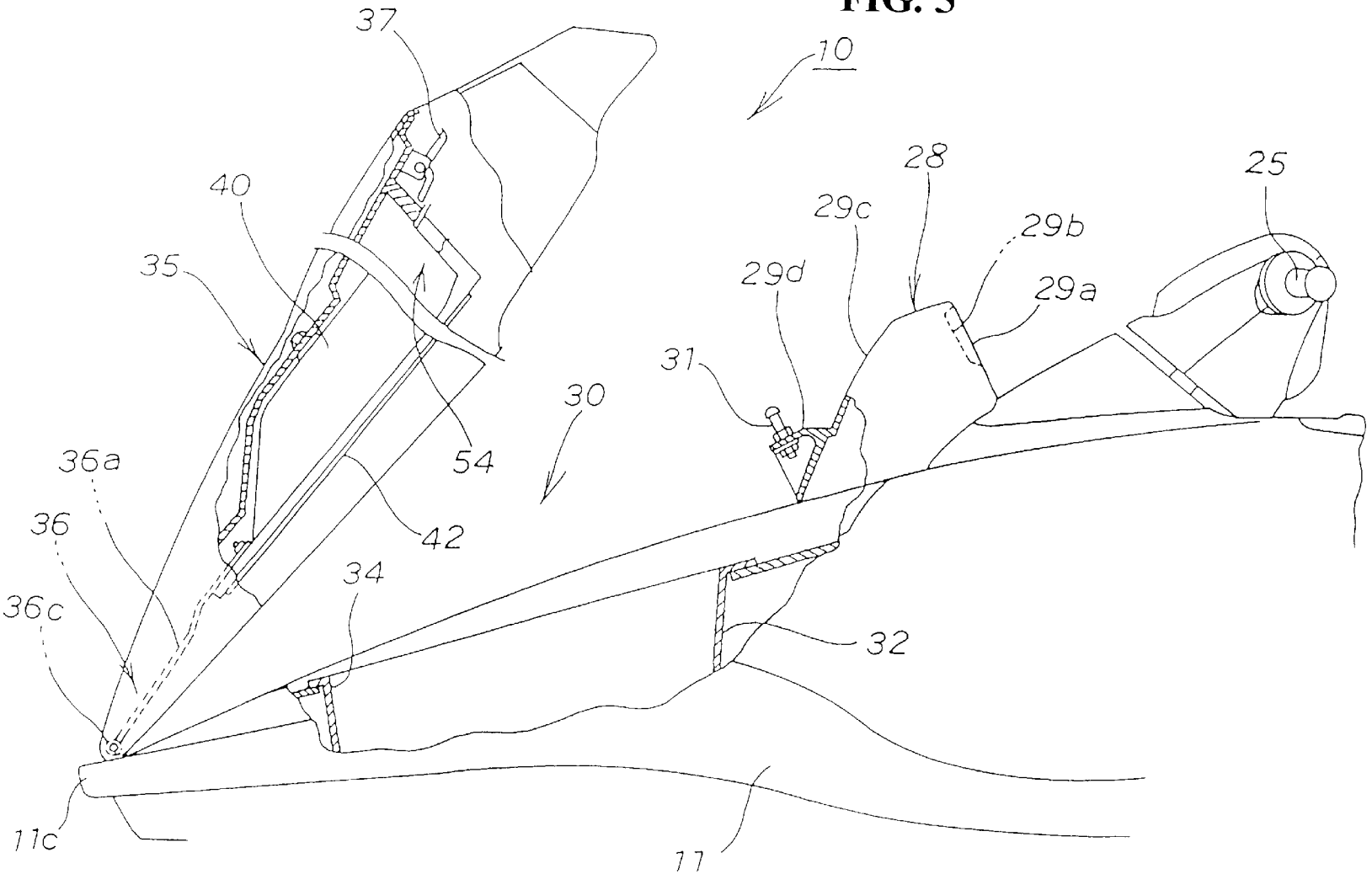
FIG. 5 is a second explanatory drawing illustrating the operation of the article storage structure for a small boat according to the present invention.
Figure 6A:
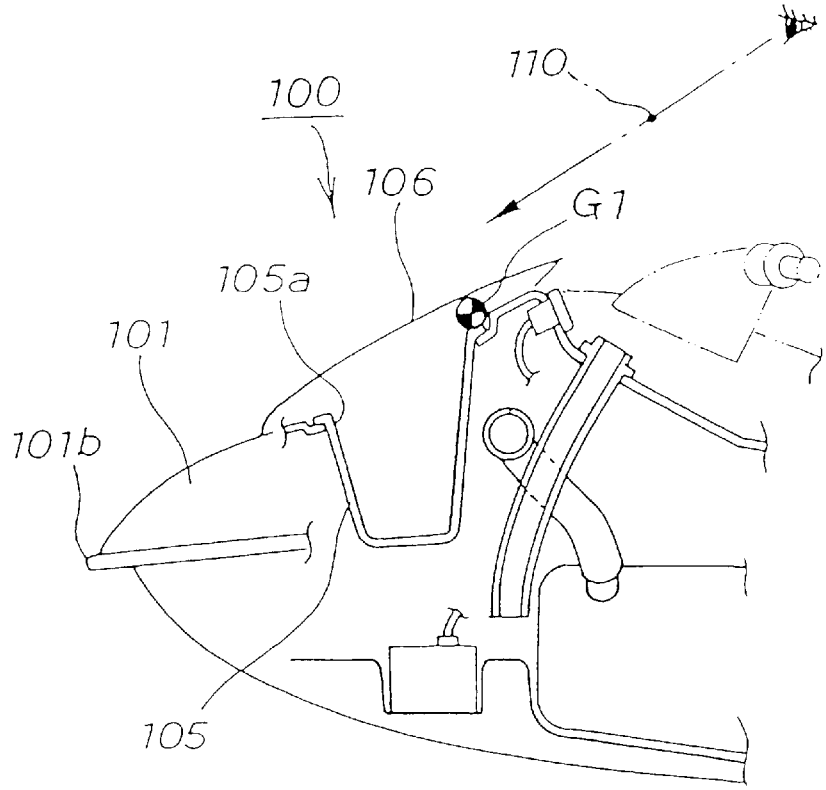
FIG. 6 is a third explanatory drawing illustrating the operation of the article storage structure for a small boat according to the present invention.
Figure 6B:
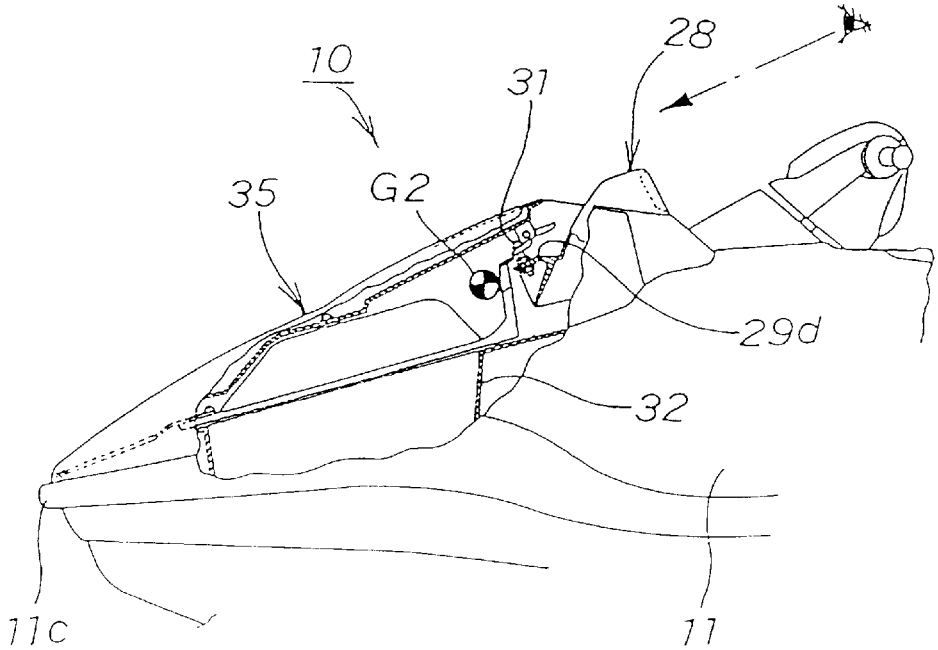
Figure 7:
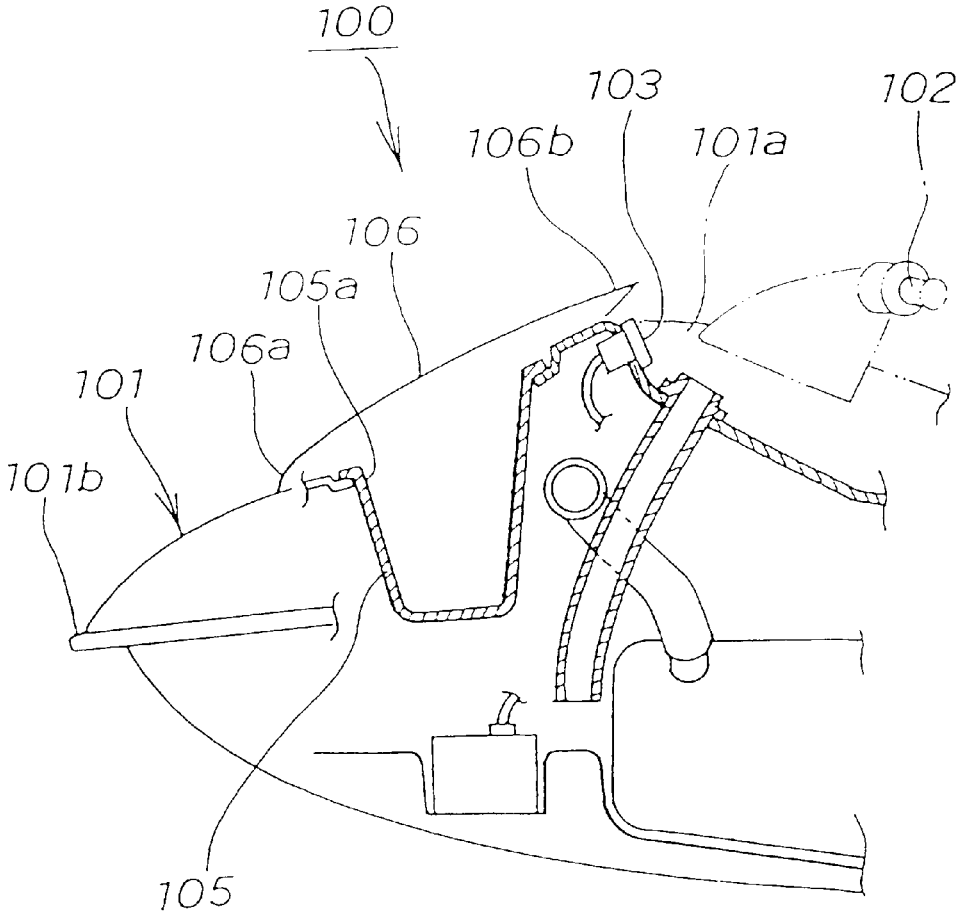
FIG. 7 is a cross sectional view of a small boat including an article storage structure of the background art.

Referring now to FIG. 4 to FIG. 6, the operation of the article storage structure 30 for a small boat will be described. FIG. 4 is a first explanatory drawing illustrating the operation of the article storage structure for a small boat according to the present invention showing a state in which the lid 35 is opened.

The operator inserts his/her hand 62 through the opening 60 between the protective cover 45 and the decorative cover 50 and the display panel 28 into the storing space 55. Then he/she operates the latch 37 with his/her hand 62 inserted into the storage space 55 to release engagement between the latch 37 and the engaging member 31. In this state, the operator lifts the rear end 35*b* of the lid 35 so as to swing about the rod 36*c* of the hinge plate 36*a* in the opening direction as shown by the arrow ①.

FIG. 5 is a second explanatory drawing illustrating the operation of the article storage structure for a small boat according to the present invention, showing a state in which the lid is lifted to the opened position.

The upper opening 34 can be opened by lifting the lid body 40 from the upper end opening 34 of the article storage box 32 by lifting the lid 35 to the opened position. As a consequence, articles can be stored in the article storage box 32 and the articles can be taken out from the article storage box 32.

FIGS. 6(*a*) and 6(*b*) are a third explanatory drawing illustrating the operation of the article storage structure for a small boat according to the present invention. FIG. 6(*a*) shows a jet propulsion boat 100 in the background art as a comparative example. FIG. 6(*b*) shows a jet propulsion boat 10 according to the preferred embodiment as a practical example.

In FIG. 6(*a*), the article storage box 105 for the jet propulsion boat 100 has an upper end opening 105*a* substantially flush with the surface of the hull 101. Accordingly, the lid 106 covering the upper end opening 105*a* is elevated upward from the surface of the hull 101. Therefore, when the operator attempts to see adjacent the distal end 101*b* of the hull 101, the operator must raise his/her body to elevate his/her eye line 110. In addition, by disposing the lid 106 so as to be elevated from the surface of the hull 101, it is difficult to lower the center of gravity G1 of the jet propulsion boat 100.

In FIG. 6(*b*), the jet propulsion boat 10 is provided with a downwardly recessed portion (that is, a mounting bracket) 29*d* forwardly of the display panel 28 and rearwardly of the article storage box 32. The mounting bracket 29*d* is provided with an engaging member 31. Therefore, since the lid 35 of the article storing box 32 can be moved downward in coordination with the engaging member 31, the operator's forward visibility is increased substantially.

In addition, since the lid 35 of the article storage box 32 can be moved downward into cooperation with the mounting bracket 29*d*, the center of gravity G2 of the jet propulsion boat 10 can be further lowered. Therefore, the steerability of the jet propulsion boat 10 can be further enhanced.

Incidentally, an example in which the recessed portion is formed by providing a mounting bracket 29*d* at the substantially center of the anteverted surface 29*c* constituting the casing 29 of the display panel 28 has been described. However, the present invention is not limited to this embodiment. It is possible to form the recessed portion with other members. The point is that the downwardly recessed portion can be formed forwardly of the display panel 28 and rearwardly of the article storage box 32 with that member.

Although an example of locking the lid 35 in the closed position has been described in the aforementioned embodiment by providing the engaging member 31 mounted on the mounting bracket 29*d* and a latch 37 on the back surface of the rear end of the protective cover 45, and engaging the latch 37 with the engaging member 31, the locking means for locking the lid 35 in the closed position is not limited thereto. It is possible to determine as appropriate in coordination with the small boat.

In addition, the jet propulsion boat 10 that is propelled by a jet pump has been taken as an example of the small boat in the aforementioned embodiment. However, the propulsion means for the small boat is not limited thereto.

The present invention thus constructed exerts the following effects.

According to the first aspect of the present invention, a downwardly recessed portion is provided forwardly of the display panel and rearwardly of the article storage box, and an engaging member is provided in this recessed portion. Therefore, the lid of the article storage box can be moved downward in coordination with the engaging member, and thus the front visibility of the operator can be increased substantially.

In addition, the lid of the article storage box can be moved downward into cooperation with the engaging member. Accordingly, the center of gravity of the small boat can further be lowered.

In this way, the visibility of the small boat can be increased substantially, and since the center of gravity of the jet propulsion boat can be lowered, the steerability of the small boat can further be enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An article storage structure in a small boat, the small boat including a handlebar disposed on a centerline along a width of a hull of the small boat and a display panel for displaying gauges, said display panel being disposed forwardly of said handle, said article storage structure comprising:

an article storage box, said article storage box being disposed forwardly of said display panel;

a lid, said lid covering an upper surface of said article storage box;

a hinge, said hinge being provided at a front end of said lid;

a locking member, said locking member being provided at a rear end of said lid for locking said lid;

a downwardly recessed portion, said downwardly recessed portion being provided forwardly of said display panel and rearwardly of said article storage box; and an engaging member to be engaged with said locking member, said engaging member being provided in said recessed portion.

2. The article storage structure according to claim 1, wherein said downwardly recessed portion is a mounting bracket extending from a front surface of said display panel.

3. The article storage structure according to claim 1, wherein said hull further comprises:

a front portion, said front portion having an upper wall thereof disposed below said display panel, said upper wall being inclined downwardly toward a distal end of said hull; and an opening, said opening being formed at a substantial center of said upper wall, wherein said article storage box is fitted into said upper wall opening.

4. The article storage structure according to claim 1, wherein said article storage box is embedded in the hull so that an upper surface of said article storage box is substantially flush with an upper wall of the hull.

5. An article storage structure in a small boat, the small boat including a handlebar disposed on a centerline along a width of a hull of the small boat and a display panel for displaying gauges, said display panel being disposed forwardly of said handle, said article storage structure comprising:

an article storage box, said article storage box being disposed forwardly of said display panel;

a lid, said lid covering an upper surface of said article storage box;

a hinge, said hinge being provided at a front end of said lid;

a locking member, said locking member being provided at a rear end of said lid for locking said lid;

a downwardly recessed portion, said downwardly recessed portion being provided forwardly of said display panel and rearwardly of said article storage box; and an engaging member to be engaged with said locking member, said engaging member being provided in said recessed portion, wherein said display panel further comprises:

a casing, said casing including an anteverted surface inclined downwardly toward a front thereof;

a mounting bracket, said mounting bracket being formed at a substantial center of the anteverted surface;

an opening formed at a rear end of said casing; and a display portion, said display portion being mounted in said opening, wherein said mounting bracket forms said recessed portion located downwardly from a top of said display panel.

6. The article storage structure according to claim 5, wherein said article storage box is embedded in the hull so that an upper surface of said article storage box is substantially flush with an upper wall of the hull.

7. The article storage structure according to claim 5, wherein said hull further comprises:

a front portion, said front portion having an upper wall thereof disposed below said display panel, said upper wall being inclined downwardly toward a distal end of said hull; and an opening, said opening being formed at a substantial center of said upper wall, wherein said article storage box is fitted into said upper wall opening.

8. The article storage structure according to claim 5, said lid further comprising:

a lid body for closing an upper end opening of said article storage box;

a protective cover for protecting said lid body; and a decorative cover for covering said protective cover.

9. The article storage structure according to claim 8, wherein said lid body further comprises:

an outer frame, said outer frame being formed into a substantially trapezoidal shape;

a seal member, said seal member being provided along said outer frame;

a hinge plate, said hinge plate being secured at a front end of said outer frame;

a central portion, said central portion being elevated upward from said outer frame; and a partition wall, said partition wall being provided at a rear end of said outer frame.

10. An article storage structure in a small boat, the small boat including a handlebar disposed on a centerline along a width of a hull of the small boat and a display panel for displaying gauges, said display panel being disposed forwardly of said handle, said article storage structure comprising:

an article storage box, said article storage box being disposed forwardly of said display panel;

a lid, said lid covering an upper surface of said article storage box, said lid further comprising:

a lid body for closing an upper end opening of said article storage box;

a protective cover for protecting said lid body; and a decorative cover for covering said protective cover;

a hinge, said hinge being provided at a front end of said lid;

a locking member, said locking member being provided at a rear end of said lid for locking said lid;

a downwardly recessed portion, said downwardly recessed portion being provided forwardly of said display panel and rearwardly of said article storage box; and an engaging member to be engaged with said locking member, said engaging member being provided in said recessed portion.

11. The article storage structure according to claim 10, wherein said lid body further comprises:

an outer frame, said outer frame being formed into a substantially trapezoidal shape;

a seal member, said seal member being provided along said outer frame;

a hinge plate, said hinge plate being secured at a front end of said outer frame;

a central portion, said central portion being elevated upward from said outer frame; and a partition wall, said partition wall being provided at a rear end of said outer frame.

12. A small boat, comprising:

a hull;

a fuel tank, said fuel tank being mounted at a front portion of said hull;

an engine, said engine being provided rearwardly of said fuel tank;

a pump chamber, said pump chamber being provided rearwardly of said engine;

a jet pump, said jet pump being provided in said pump chamber;

a handlebar disposed on a centerline along a width of a hull of the small boat;

a seat, said seat being mounted rearwardly of said handlebar;

a display panel for displaying gauges, said display panel being disposed forwardly of said handle;

an article storage box disposed forwardly of said display panel;

a lid covering an upper surface of said article storage box;

a hinge provided at a front end of said lid;

a locking member provided at a rear end for locking the lid;

a downwardly recessed portion, said downwardly recessed portion being provided forwardly of said display panel and rearwardly of said article storage box; and an engaging member to be engaged with said locking member, said engaging member being provided in said recessed portion.

13. The small boat according to claim 12, wherein said hull further comprises:

a front portion, said front portion having an upper wall thereof disposed below said display panel, said upper wall being inclined downwardly toward a distal end of said hull; and an opening, said opening being formed at a substantial center of said upper wall, wherein said article storage box is fitted into said upper wall opening.

14. The small boat according to claim 12, wherein said downwardly recessed portion is a mounting bracket extending from a front surface of said display panel.

15. The small boat according to claim 12, wherein said article storage box is embedded in the hull so that an upper surface of said article storage box is substantially flush with an upper wall of the hull.

16. The small boat according to claim 12, said lid further comprising:

a lid body for closing an upper end opening of said article storage box;

a protective cover for protecting said lid body; and a decorative cover for covering said protective cover.

17. The small boat according to claim 16, wherein said lid body further comprises:

an outer frame, said outer frame being formed into a substantially trapezoidal shape;

a seal member, said seal member being provided along said outer frame;

a hinge plate, said hinge plate being secured at a front end of said outer frame;

a central portion, said central portion being elevated upward from said outer frame; and a partition wall, said partition wall being provided at a rear end of said outer frame.

18. The small boat according to claim 12, wherein said display panel further comprises:

a casing, said casing including an anteverted surface inclined downwardly toward a front thereof;

a mounting bracket, said mounting bracket being formed at a substantial center of the anteverted surface;

an opening formed at a rear end of said casing; and a display portion, said display portion being mounted in said opening, wherein said mounting bracket forms said recessed portion located downwardly from a top of said display panel.

19. The small boat according to claim 18, wherein said hull further comprises:

a front portion, said front portion having an upper wall thereof disposed below said display panel, said upper wall being inclined downwardly toward a distal end of said hull; and an opening, said opening being formed at a substantial center of said upper wall, wherein said article storage box is fitted into said upper wall opening.

20. The small boat according to claim 18, wherein said article storage box is embedded in the hull so that an upper surface of said article storage box is substantially flush with an upper wall of the hull.

21. The small boat according to claim 18, said lid further comprising:

a lid body for closing an upper end opening of said article storage box;

a protective cover for protecting said lid body; and a decorative cover for covering said protective cover.

22. The small boat according to claim 21, wherein said lid body further comprises:

an outer frame, said outer frame being formed into a substantially trapezoidal shape;

a seal member, said seal member being provided along said outer frame; a hinge plate, said hinge plate being secured at a front end of said outer frame; a central portion, said central portion being elevated upward from said outer frame; and a partition wall, said partition wall being provided at a rear end of said outer frame.

* * * * *